US012616287B2

(12) United States Patent
Nunnery

(10) Patent No.: US 12,616,287 B2
(45) Date of Patent: May 5, 2026

(54) HAIR LOCKING DEVICE AND METHOD OF USING THE SAME

(71) Applicant: Chelsey Nunnery, Stockbridge, GA (US)

(72) Inventor: Chelsey Nunnery, Stockbridge, GA (US)

( * ) Notice: Subject to any disclaimer, the term of this patent is extended or adjusted under 35 U.S.C. 154(b) by 314 days.

(21) Appl. No.: 18/302,689

(22) Filed: Apr. 18, 2023

(65) Prior Publication Data

US 2024/0349860 A1 Oct. 24, 2024

(51) Int. Cl.
*A45D 2/00* (2006.01)

(52) U.S. Cl.
CPC ..... *A45D 2/00* (2013.01)

(58) Field of Classification Search
CPC ..... A45D 2/00; A45D 2/02; A45D 2002/005; A45D 2002/006; A45D 2002/007; A45D 2002/008
See application file for complete search history.

(56) References Cited

U.S. PATENT DOCUMENTS 3,071,917 A * 1/1963 Fisher ..... D02G 1/00 57/29
5,456,271 A * 10/1995 Legette ..... A45D 2/00 132/200
5,967,150 A * 10/1999 Wright ..... A45D 24/007 132/119.1
6,318,378 B1 * 11/2001 Kennedy ..... A45D 2/00 132/200
6,962,159 B1 * 11/2005 Adam ..... A45D 6/02 57/29
7,232,446 B1 * 6/2007 Farris ..... A61B 17/06166 112/169
9,198,493 B2 12/2015 Hall
2003/0234026 A1 * 12/2003 Nakamura ..... A46B 15/0002 132/144
2004/0216758 A1 * 11/2004 Rascoe ..... D04D 1/04 132/200
2010/0006117 A1 1/2010 Gutierrez Ugarte
2010/0036317 A1 * 2/2010 Oginski ..... A61M 37/00 606/186
2018/0220766 A1 * 8/2018 De Sars ..... A45D 2/08
2022/0040873 A1 2/2022 Huntt

* cited by examiner

*Primary Examiner* — Nicholas D Lucchesi
(74) *Attorney, Agent, or Firm* — Alston & Bird LLP

(57) ABSTRACT

Various embodiments are directed to hair locking device and methods of using the same. In various embodiments, a hair locking device comprises a device body comprising a housing defining an interior housing portion and a motor assembly, an arm component attachable to the device body comprising a head element defining by an interior head channel and a hair engagement tool operatively connected to the motor assembly, wherein the hair engagement tool is configured to be moved by the motor assembly relative to the arm component, and wherein the hair engagement tool comprises a engagement feature configured for selective engagement with the hair portion, wherein the hair locking device is operable to initiate a motor-driven movement of the hair engagement tool defined by the engagement feature moving relative to the interior head channel to enable an interaction of the engagement feature with the a hair portion.

20 Claims, 7 Drawing Sheets

HAIR LOCKING DEVICE AND METHOD OF USING THE SAME

FIELD OF THE INVENTION

Various embodiments described herein relate generally to relate generally to hair styling tools, and more particularly, to a hair locking device for forming dreadlocks.

BACKGROUND

Applicant has identified many technical challenges and difficulties associated with conventional hair styling devices for styling hair into dreadlocks. Through applied effort, ingenuity, and innovation, Applicant has solved problems related to these hair styling devices by developing solutions embodied in the present disclosure, which are described in detail below.

BRIEF SUMMARY

Various embodiments are directed to a hair locking device and method of using the same. In various embodiments, a hair locking device may comprise a device body comprising: a housing defining an interior housing portion; and a motor assembly disposed within the interior housing portion of the housing; an arm component configured for attachment to the device body, the arm component comprising a head element having a tubular configuration defined at least in part by an interior head channel configured for receiving a hair portion therein; and a hair engagement tool operatively connected to the motor assembly, wherein the hair engagement tool is configured to be moved through a range of motion relative to the arm component based at least in part on a selective operation of the motor assembly, and wherein the hair engagement tool comprises a engagement feature configured for selective engagement with the hair portion; wherein the hair locking device is configured to be selectively operated to initiate a motor-drive movement of the hair engagement tool defined by the engagement feature moving relative to the interior head channel to enable a hair locking operation defined at least in part by an interaction of the engagement feature with the hair portion.

In various embodiments, the arm component may be selectively detachable housing of the device body. In various embodiments, the arm component may comprise a stem element configured for attachment to the device body, wherein the stem element defines a stem length between a first stem end and a second stem end, and wherein the head component is arranged relative to the second stem end and an arm attachment feature of the stem element is defined at the first stem end. In certain embodiments, the head element may be arranged in an at least substantially perpendicular configuration relative to the stem element. In certain embodiments, the stem element may define an interior stem channel that is fluidly connected to the interior housing portion of the housing of the device body via a first opening defined at the first stem end of the stem element. In certain embodiments, the interior stem channel of the stem element may be fluidly connected to the interior head channel via a second opening defined at the second stem end of the stem element.

In various embodiments, the engagement feature of the hair engagement tool may define a two-pronged engagement element. In various embodiments, the hair engagement tool may further comprise an elongated stem and an attachment feature, the attachment feature being configured for engagement with at least a portion of the motor assembly to facilitate the operative connection of the hair engagement tool thereto. In certain embodiments, the attachment feature may be defined at a first end of the elongated stem and the engagement feature is defined on an opposing second end of the elongated stem. In various embodiments, the hair locking device may be configured such that the movement of the hair engagement tool through the range of motion is defined at least in part by the engagement feature moving in one or more longitudinal directions. In certain embodiments, the hair engagement tool moving through the first range of motion may be defined at least in part by the engagement feature being moved between a first position defined within the interior head channel of the head element and a second position defined within an interior stem channel of a stem element defined by the arm component.

In various embodiments, the hair engagement tool may be made of an at least substantially metallic material. In various embodiments, the head element of the arm component may comprise tool orifice fluidly connected with the interior head channel. In certain embodiments, the tool orifice may be at least partially aligned with a central axis of a stem element of the arm component, the stem element being disposed between the head element and the housing of the device body. In various embodiments, the hair locking device may further comprise a removeable head insert component configured to be selectively secured relative to the head element to reduce an operable cross-sectional area within which the head element is configured to receive the hair portion. In certain embodiments, the removeable head insert component may comprise a removeable tube insert configured to be disposed within the interior head channel of the head element, the removeable tube insert defining an interior insert channel defined by a first cross-sectional area that is at least substantially less than a second cross-sectional area defined by the interior head channel. In certain embodiments, the removeable head insert component may further comprise a detachable insert cap configured to selectively engage the removeable tube insert to secure the removeable tube insert in one or more directions relative to the head element.

In various embodiments, the motor assembly may comprise a drive motor operable to drive rotation of a motor stem, and a motor wheel defining a first opening configured for engagement with the to the motor stem such that the motor wheel is configured to rotate about an axis of rotation defined by a central axis of the motor stem. In certain embodiments, the motor wheel may further define a second opening configured to receive a fastener element therein such that an attachment feature of the hair engagement tool is secured relative to the second opening of the motor wheel, and wherein the second opening is defined at a radial distance away from the axis of rotation of the motor wheel such that the rotation of the motor stem operably causes the attachment feature of the hair engagement tool to rotate about the axis of rotation with the motor wheel. In certain embodiments, the motor assembly may be electronically connected to an activation button disposed about an exterior surface of the housing such that the drive motor of the motor assembly is selectively operable via one or more user interactions with the activation button.

BRIEF DESCRIPTION OF THE DRAWINGS

Reference will now be made to the accompanying drawings, which are not necessarily drawn to scale, and wherein.

DETAILED DESCRIPTION

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

Dreadlocks are a style of wearing one's hair in which hairs are formed into tightly wound coils to embody ropes of hair. Traditionally, dreadlocks can be formed naturally and can vary greatly in diameter and the degree of tightness defined by the bundle and/or lock of hair. There are methods by which a hair stylist can seek to style the hair in a more even, tightly-wound hair portion to create a dreadlock with a neater appearance. Such methods are often referred to as "locking." Whether a stylist is looking to initially style a portion of a person's hair in a dreadlock for the first time, or simply providing maintenance to a dreadlock that has become progressively more unkempt over-time, a need exists for an easier, less labor-intensive means of working with a large portion of hair to lock the hair in the form of tight, kempt dreadlock.

Having described example embodiments, the design of the various devices performing various example operations is provided below. The components illustrated in the figures represent components that may or may not be present in various embodiments of the disclosure described herein such that embodiments may include fewer or more components than those shown in the figures while not departing from the scope of the disclosure.

Figure 1:
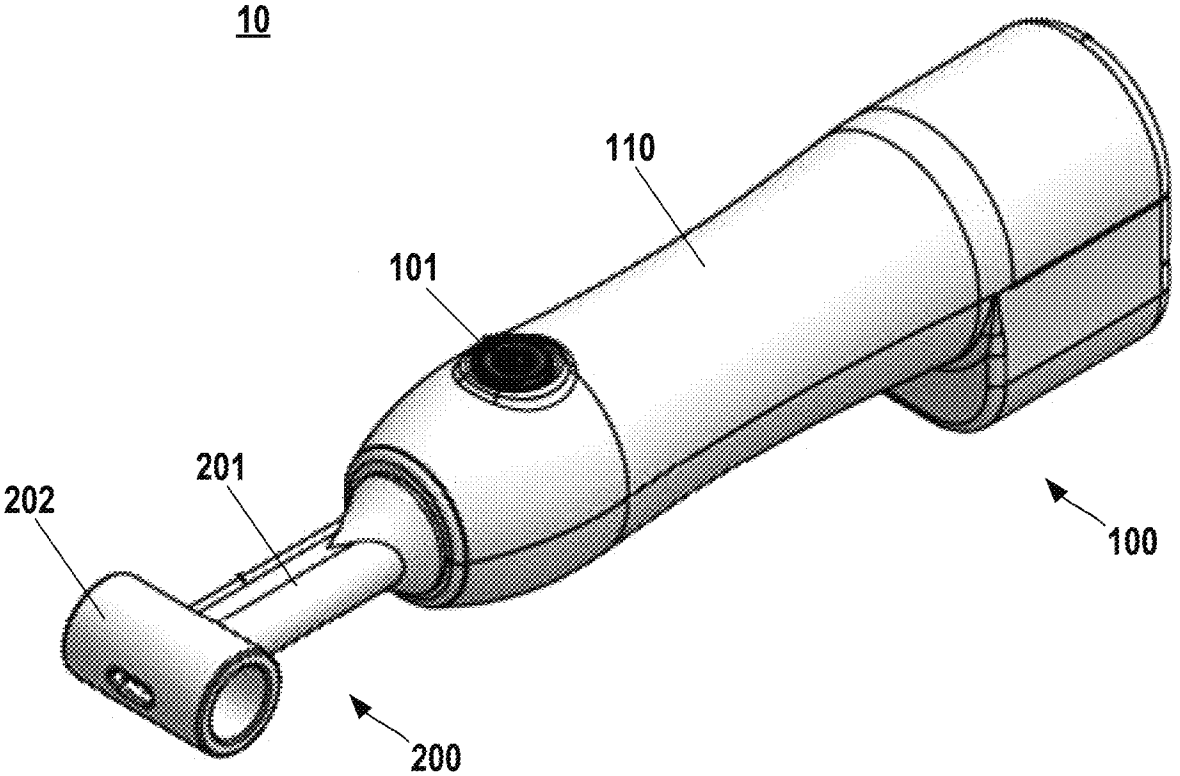
FIG. 1 illustrates a perspective view of an exemplary hair locking device in accordance with various embodiments described herein.

FIG. 1 illustrates a perspective view of an exemplary hair locking device in accordance with various embodiments described herein. In particular, FIG. 1 illustrates a perspective view of a hair locking device 10 configured to interact with hair of a user to facilitate a forming of a dreadlock. In various embodiments, an exemplary hair locking device 10 may comprise a device body 100 and an arm component 200 arranged to extend from the device body 100. For example, as described herein, in various embodiments, the arm component 200 of an exemplary hair locking device 10 may be selectively detachable from the device body 100 to facilitate replacement of the arm component subsequent to one or more uses of the hair locking device 10. In various embodiments, the device body 10 may comprise a housing 110 embodying an exterior shell configured to house one or more internal components of the hair locking device 10, including, but not limited to, a motor assembly and/or at least a portion of a hair engagement tool, within an interior portion thereof. As illustrated, in various embodiments, the housing 110 of the device body 100 may comprise a first housing portion 111 and a second housing portion 112 that may be detachably fastened relative to one another to collectively define an exterior shell of the housing 110 and the interior housing portion therein.

In various embodiments, the hair locking device 10 may further comprise an activation button 101 provided along an exterior portion of the housing 110, such as, for example, along the surface of the upper housing portion 111 of the housing 110 so as to be accessible to a user for selective interaction therewith. In various embodiments, the activation button 101 may be electronically connected to the motor assembly of the hair locking device 10, as described herein. For example, in various embodiments, the activation button may be selectively activated (e.g., pressed, flipped, and/or the like) to control movement of a hair engagement tool relative to the arm component 200 based on one or more electronic signals transmitted to the motor assembly (e.g., by initiating and/or ceasing operation of the drive motor communicatively connected therewith).

As illustrated, the exemplary hair locking device 10 may comprise an arm component 200 comprising a stem element 201 and a head element 202. As illustrated, the stem element 201 may be configured for attachment to the housing 110 of the device body 100 to secure the arm component 200 relative to the device body 100. In various embodiments, the stem element 201 may define an at least partially hollow configuration such that the arm component 200 is configured to receive at least a portion of the hair engagement tool of the hair locking device 10, as described herein, within an interior channel of the stem element 201. Further, the head element 202 of the arm component 200 may comprise an at least substantially tubular configuration such that the head element 202 is configured to receive at least a portion of a user's hair within an interior channel thereof. As described in further detail herein, the arm component 200 is configured to facilitate an interaction between the hair engagement tool and the portion of the user's hair provided within the head element 202. For example, the hair locking device 10 may be selectively operated to initiate engagement of the hair engagement tool with the portion of hair disposed within the interior channel of the head element 202 such that the hair may be repositioned or otherwise manipulated by a user (e.g., a stylist) via one or more movements of the hair locking device 10.

Figure 2:
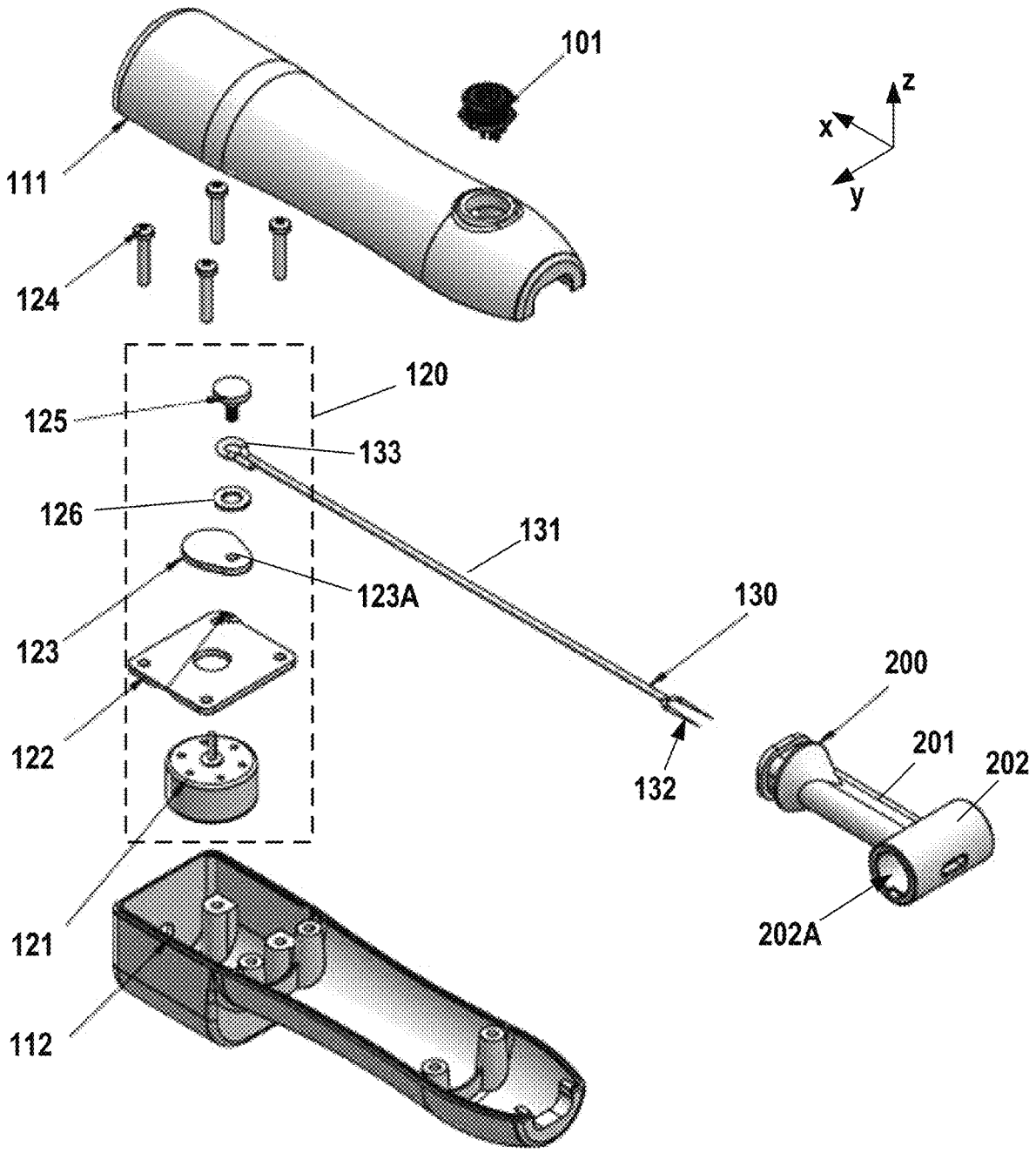
FIG. 2 illustrates an exploded view of an exemplary hair locking device in accordance with various embodiments described herein.

FIG. 2 illustrates an exploded view of an exemplary hair locking device in accordance with various embodiments described herein. In various embodiments, an exemplary hair locking device 10 may comprise a motor assembly 120 and a hair engagement tool 130. As illustrated, in various embodiments, the housing 110 of the device body 100 may comprise a first housing portion 111 and a second housing portion 112 that may be detachably fastened relative to one another to collectively define an exterior shell of the housing 110 and the interior housing portion therein. For example, the motor assembly 120 may be configured to be secured relative to a second housing portion 112 such that at least a portion of the motor assembly 120 is secured relative to the housing 110 within the interior housing portion.

In various embodiments, the motor assembly 120 may be configured to operate to drive movement of a hair engagement tool 130 secured thereto. For example, upon user activation of the activation button 101, the motor assembly 120 may operate to cause the hair engagement tool 130 to move through a range of motion, as described herein, in order to define an operation of the hair locking device 10. In various embodiments, as described herein in further detail, the operation of the motor assembly 120 may be defined at least in part by an operation of a drive motor 121 that causes a wheel element 123 secured to a rotatable portion of the motor 121 to rotate about a rotation of axis defined by the motor 121, such that the hair engagement tool 130 fixedly secured relative to the wheel component 123 via a pin 125 is driven through a corresponding range of motion defined relative to the housing 110, as described herein.

In various embodiments, an exemplary hair locking device 10 may comprise a hair engagement tool 130 operatively connected to the motor assembly 120 and configured to selectively engage the hair of a user via one or more motor-driven movements defined relative to the arm component 200 (e.g., the head element 202) of the hair locking device 10. As illustrated, the hair engagement tool 130 may embody an at least substantially elongated configuration defined at least in part by an elongated stem 131, one or more hair engagement features 132 provided at a first end of the elongated stem 131, and an attachment feature 133 provided at an opposite second end of the elongated stem 131. In various embodiments, the hair engagement tool 130 may be made of an at least substantially rigid material such as, for example, a metal material, a plastic material, a composite material, and/or the like, or any other material operable to maintain its structural integrity while being driven through a range of motion and interacting with hair of a user, as described herein.

In various embodiments, the one or more hair engagement features 132 of an exemplary hair engagement tool 132 may be embody a pronged feature, a spear, a pointed feature, and/or the like, or any other feature operable to facilitate selective engagement with hair (e.g., a bundle of hair) as described herein, or any combination thereof. As a non-limiting example, the one or more engagement feature 132 of the hair engagement tool 130 illustrated in FIG. 2 embodies a two-pronged feature resembling a pitchfork. Further, in various embodiments, the attachment feature 133 of an exemplary hair engagement tool 130 may comprise a looped feature, an aperture, a hook, and/or the like, or any other attachment feature configured to be engaged by a pin 125 of the motor assembly 120 to secure the hair engagement tool 130 relative to the motor assembly 120 by restricting the attachment feature 133 from moving in one or more linear directions relative to the motor wheel 123.

Figure 3:
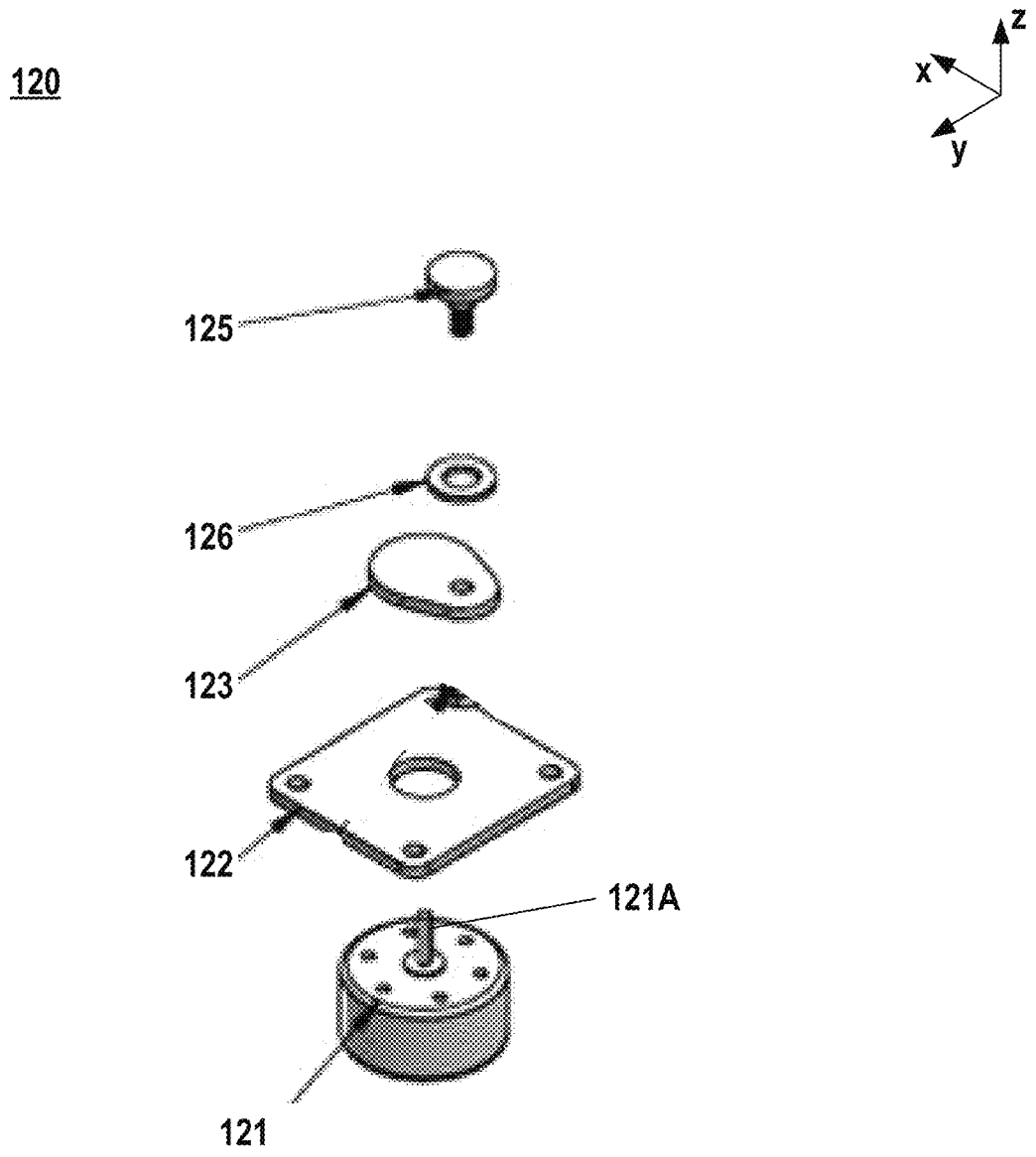
FIG. 3 illustrates an exploded view of an exemplary motor assembly in accordance with various embodiments described herein.

FIG. 3 illustrates an exploded view of a motor assembly of an exemplary hair locking device 10. In particular, FIG. 3 illustrates an exploded view of an exemplary motor assembly 120 configured to be selectively operable to facilitate operation of the hair locking device by driving the movement of a hair engagement tool secured thereto (e.g., the hair engagement tool 130 illustrated in the exemplary embodiment of FIG. 2) to cause an interaction of the hair engagement tool with hair disposed within the arm component of the hair locking device. As illustrated, an exemplary motor assembly 120 may comprise a drive motor 121, a motor plate 122, a motor wheel 123, a pin 125, and one or more fastener elements 124.

In various embodiments, the drive motor 121 of exemplary motor assembly 120 may comprise a drive motor 121 configured to, upon being activated (e.g., by user engagement with an activation button electronically connected therewith), cause a motor stem 121A of the drive motor 121 to rotate about a central axis thereof. For example, as illustrated, the exemplary drive motor 121 may be operable to cause the motor stem 121A to rotate about an axis of rotation defined in the z-direction, as defined by the exemplary orientation of the embodiment illustrated in FIG. 3. As a non-limiting example provided for illustrative purposes, the drive motor 121 may comprise low-voltage DC motor configured to operate such that the motor stem 121A of the drive motor 121 rotates about a central axis thereof a rotational speed of at least approximately 7000 RPM.

In various embodiments, the motor plate 122 of the motor assembly 120 may comprise a central opening configured to receive the rotatable motor stem 121A of the drive motor therethrough and one or more apertures configured to receive a respective fastener element therethrough such that the motor plate 122 may be secured within the interior housing portion relative to an interior surface of the housing. For example, in various embodiments, the one or more fastener elements 124 of the motor assembly 120 may each embody a screw, bolt, and/or the like, or any other fastener configured for coupling the motor plate 122 relative to the housing of the hair locking device, as described herein. The motor assembly 120 may be configured such that, upon the one or more fastener elements 124 (e.g., bolts) being provided through a corresponding aperture of the motor plate 122 and engaging a respective portion of the housing of the hair locking device, the motor plate 122 be function to secure the drive motor 121 in place by pressing against the drive motor 121 to provide at least partial coverage over the motor and/or to prevent the drive motor from moving in one or more linear directions relative to interior surface of the housing engaged therewith.

As illustrated, the motor wheel 123 of an exemplary motor assembly 120 may comprise a first opening (not shown) defined along a first surface of the motor wheel 123 that is configured to receive at least a distal end of the motor stem 121A of the drive motor 121 therein. The motor wheel 123 may be coupled relative to the motor stem 121A (e.g., at the first opening) such that operation of the drive motor 121 may cause the motor wheel 123 to exhibit a corresponding rotation about an axis of rotation defined by the motor stem 121A of the drive motor 121. As described in further detail herein, the motor-driven rotation of the motor wheel 123 about an axis of rotation defined by the motor stem 121A may at least partially define the movement of the hair engagement tool during operation of the hair locking device Referring back to the exemplary hair locking device 10 illustrated in FIG. 2, the hair engagement tool 130 may be operably secured relative to the motor assembly 120 via the pin 125 of the motor assembly 120 being engaged with the attachment feature 133 so as to secure the attachment feature 133 against at least a portion of the motor assembly 120, such as, for example, a washer 126 and/or a surface of the motor wheel 123, such that the attachment feature 133 is moved within the interior housing portion of the housing 110 along with the motor-driven rotation of the motor wheel 123.

In various embodiments, an operation of the hair locking device 10 (e.g., a locking operation executed by the hair locking device 10) may be defined the motor-driven rotation of the motor wheel 123 causing the hair engagement tool 130 to move relative to the arm component 200 through a range of motion. For example, as described herein, as the drive motor 121 rotates the motor wheel 123 about a n axis of rotation defined by the motor stem 121A, the attachment feature 133 of the hair engagement tool 130 secured to the motor wheel 123 at a radial distance away from the axis of rotation moves (e.g., rotates) with the motor wheel 123 such that the elongated stem 131 (e.g., and the engagement feature 123 defined at an opposing end thereof) exhibits a linear translation at least partially in a longitudinal direction (e.g., in the x-direction as defined by the exemplary orientation of the embodiment illustrated in FIG. 2). For example, the hair locking device 10 may be configured such that as the motor wheel 123 is rotated through a full 360-degree rotational range of motion about the central axis of the motor stem 121A to change the angular position of the attachment feature 133 about the axis of rotation, the engagement feature 132 of the hair engagement tool 130 may exhibit a resultant longitudinal movement (e.g., (e.g., in the x-direction as defined by the exemplary orientation of the embodiment illustrated in FIG. 2) relative to the interior head channel 202A of the arm component 202. In such an exemplary configuration, the motor assembly 120 (e.g., the drive motor 121) being operated to move the hair engagement tool 130 through the range of motion may be defined by the hair engagement tool 130 (e.g., the engagement feature 132) being moved in one or more directions at least partially towards and/or away from the arm component 200 of the hair locking device 10 such that the engagement feature 132 of the hair engagement tool 130 is moved into and out of the interior head channel 202A defined by the head element 202 of the arm component 200 to facilitate selective engagement with a portion of a user's hair provided therein.

Figure 4A:
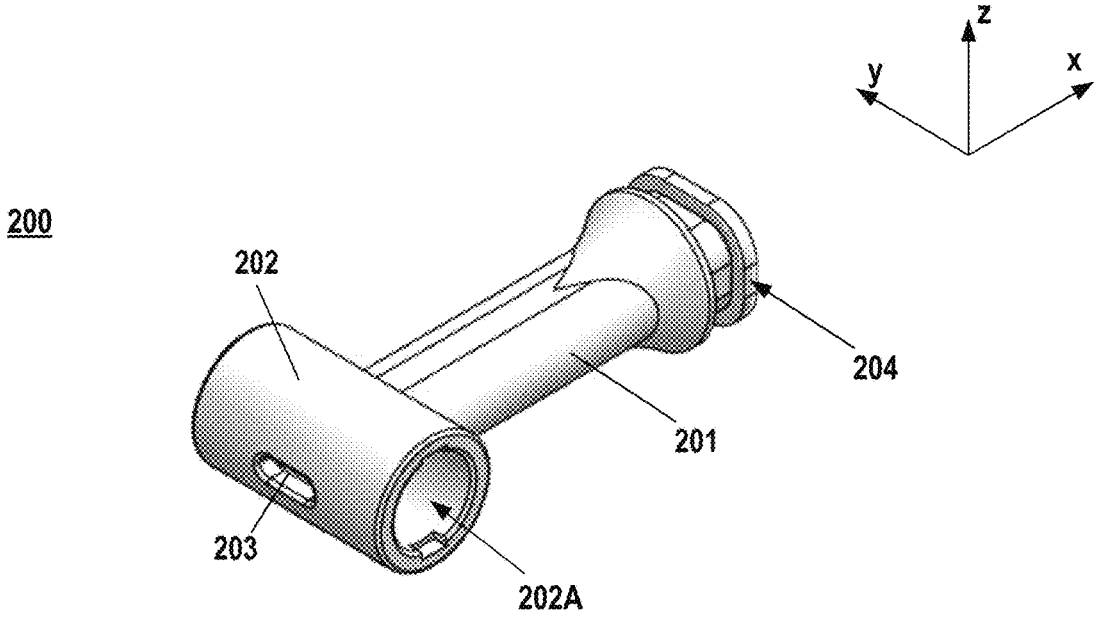
FIGS. 4A and 4B illustrate various views of an exemplary arm component in accordance with various embodiments described herein.
Figure 4B:
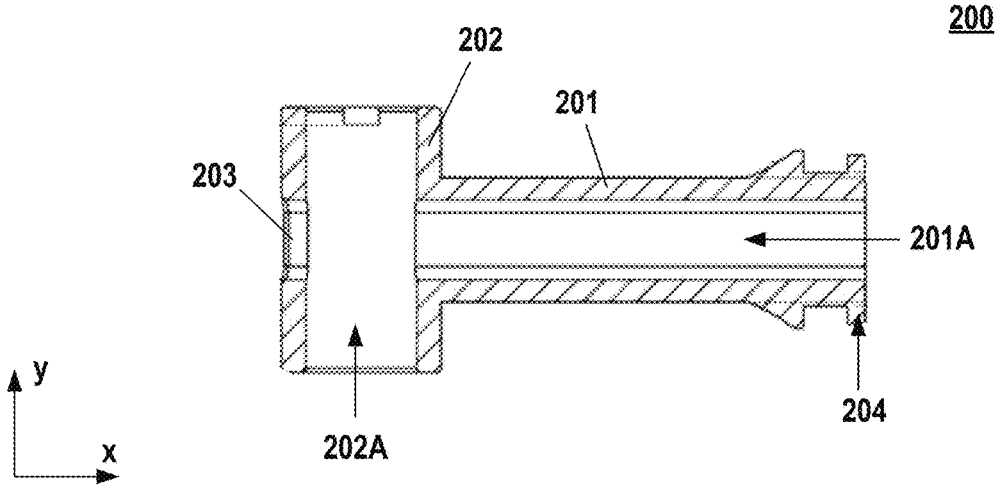

FIGS. 4A and 4B illustrate various views of an exemplary arm component in accordance with various embodiments described herein. In particular, FIGS. 4A and 4B illustrate an arm component 200 that is configured for attaching to the device body of an exemplary hair locking device and receiving a designated portion of hair of a user within an interior head channel 202A, so as to enable the execution of a locking operation by facilitating interaction between the hair engagement tool secured relative to the device body and the designated portion of hair disposed within the interior head channel 202A.

In various embodiments, the exemplary arm component 200 may comprise a stem element 201 defined at least in part by a length that extends between a first stem end and a second stem end. As illustrated, an exemplary arm component 200 may be configured such that an arm attachment feature 204 is provided at the first stem end of the stem element 201 and a head element 202 providing at the opposing second stem end of the stem element 201. The arm component 200 may be configured to be attached relative to the device body (device body 100, as illustrated in FIG. 1) of the hair locking device via the arm attachment feature 204 defined at the first stem end of the stem element 201. For example, the arm attachment feature 204 may be defined by one or more threaded elements configured for engagement with a corresponding element defined by the device body, and/or any other feature configured to facilitate the at least semi-permanent attachment (e.g., detachable) of the arm component 200 to the device body of the hair locking device.

In various embodiments, as illustrated, the arm component 200 of an exemplary hair locking device may have an at least substantially T-shaped configuration defined by the stem element 201 and the head element 202. For example, the stem element 201 and the head element 202 of an exemplary arm component 200 may each define an at least substantially tubular configuration having a length that is oriented along a respective central axis thereof. In various embodiments, the head element 202 may be arranged in an at least substantially perpendicular orientation relative to the stem element 201, such as, for example, wherein a first central axis defined by the stem element 201 is oriented in a first direction (e.g., along an x-axis, as defined by the exemplary orientation of the embodiment illustrated in FIGS. 4A and 4B) and a second central axis defined by the head element 202 is oriented in a second direction at least substantially perpendicular to the first central axis (e.g., along a y-axis, as defined by the exemplary orientation of the embodiment illustrated in FIGS. 4A and 4B).

In various embodiments, the stem element 201 and the head element 202 of an exemplary arm component 200 may each comprise an at least substantially tubular configuration defined by a respective interior channel. For example, as illustrated, the stem element 201 may define an interior stem channel 201A and the head element 202 may define an interior head channel 202A. The interior stem channel 201A may span the length of the stem element between a first opening defined at the first stem end of the stem element 201 and a second opening defined at the opposing second stem end of the stem element 201. In various embodiments, the stem element 201 may be configured such that, in an exemplary configuration wherein the arm component 200 is coupled to the device body (e.g., via the arm attachment feature 204), the interior stem channel 201 may be fluidly connected to the interior housing portion of the housing of the device body via the first opening provided at the first stem end. For example, the arm component 200 may be arranged relative to the device body such that the stem element 201 is configured to receive at least a portion of the hair engagement tool (e.g., the hair engagement tool 130 of the exemplary embodiment illustrated in FIG. 2), such as, for example, the engagement feature and/or at least a portion of the elongated stem, protruding from the housing of the device body within the interior stem channel 201A.

Further, the interior stem channel 201 may be fluidly connected to an interior head channel 202A defined by the head element 202 of the arm component 200 via a second opening defined at the second stem end of the stem element 201. For example, the arm component 200 may be configured such that at least a portion of the hair engagement tool protruding from the interior stem channel 201A of the stem element 201 (e.g., via the second opening) is received within the interior head channel 202A as the hair engagement tool is moved through a range of motion during operation of the hair locking device. As a non-limiting, illustrative example, in various embodiments, the arm component 200 may receive a designated portion of hair within the interior head channel 202A such that the portion of hair is oriented in a direction at least substantially parallel to the central axis of the head element 202 (e.g., arranged in a direction at least substantially parallel to the y-direction as defined by the exemplary orientation of the embodiment illustrated in FIGS. 4A and 4B) The arm component 200 may be configured such that, upon the hair locking device being activated such that the motor assembly of the hair locking device causes the engagement feature of the hair engagement tool to be moved in an at least partially outward direction from the interior stem channel 201A into the interior head channel 202A, at least a portion of the hair disposed within the interior head channel 202A may be engaged by the hair engagement tool (e.g., the engagement feature) in order to facilitate execution of a locking operation.

In various embodiments, the head element 202 of the arm component 200 may comprise a tool orifice 203 defined by an opening that extends through the head element 202 of the arm component. For example, the tool orifice 203 may embody an opening, an aperture, a slot, and/or the like that extends between the interior head channel 202A and an exterior surface of the head element 202. In various embodiments, the tool orifice 203 may be provided along an opposing end (e.g., an outermost portion) of the head element 202 relative to the stem element 201 of the arm component 200. In various embodiments, the tool orifice 203 may be positioned along the head element 202 such that at least a portion of the tool orifice 203 is aligned with the central axis of the stem element 201 (e.g., the interior stem channel 201A). For example, the tool orifice 203 may be at least partially aligned with the interior stem channel 201A such that the during operation of the hair locking device, as a hair engagement tool is driven in an outward direction (e.g., in the negative x-direction as defined by the exemplary orientation illustrated in FIGS. 4A and 4B) towards and/or into the interior head channel 202A, at least a portion of the engagement feature of the hair engagement tool may be moved beyond the interior head channel 202A such that it may be received within the tool orifice 203. For example, the tool orifice 203 may be configured to receive at least a portion of the hair engagement tool when the hair engagement tool is arranged in an outermost position relative to the device body (e.g., as defined in the longitudinal direction, such as the x-direction in the exemplary orientation illustrated in the embodiment illustrated in FIGS. 4A and 4B). In such an exemplary configuration, the tool orifice 203 may be configured to enable the hair engagement tool to move through a full range of motion defined by at least a portion of the engagement feature thereof being moved from a first longitudinal position within the interior stem channel 201A, through a cross-sectional diameter of the interior head channel 202A, and to a second longitudinal position within the tool orifice 203.

Figure 5A:
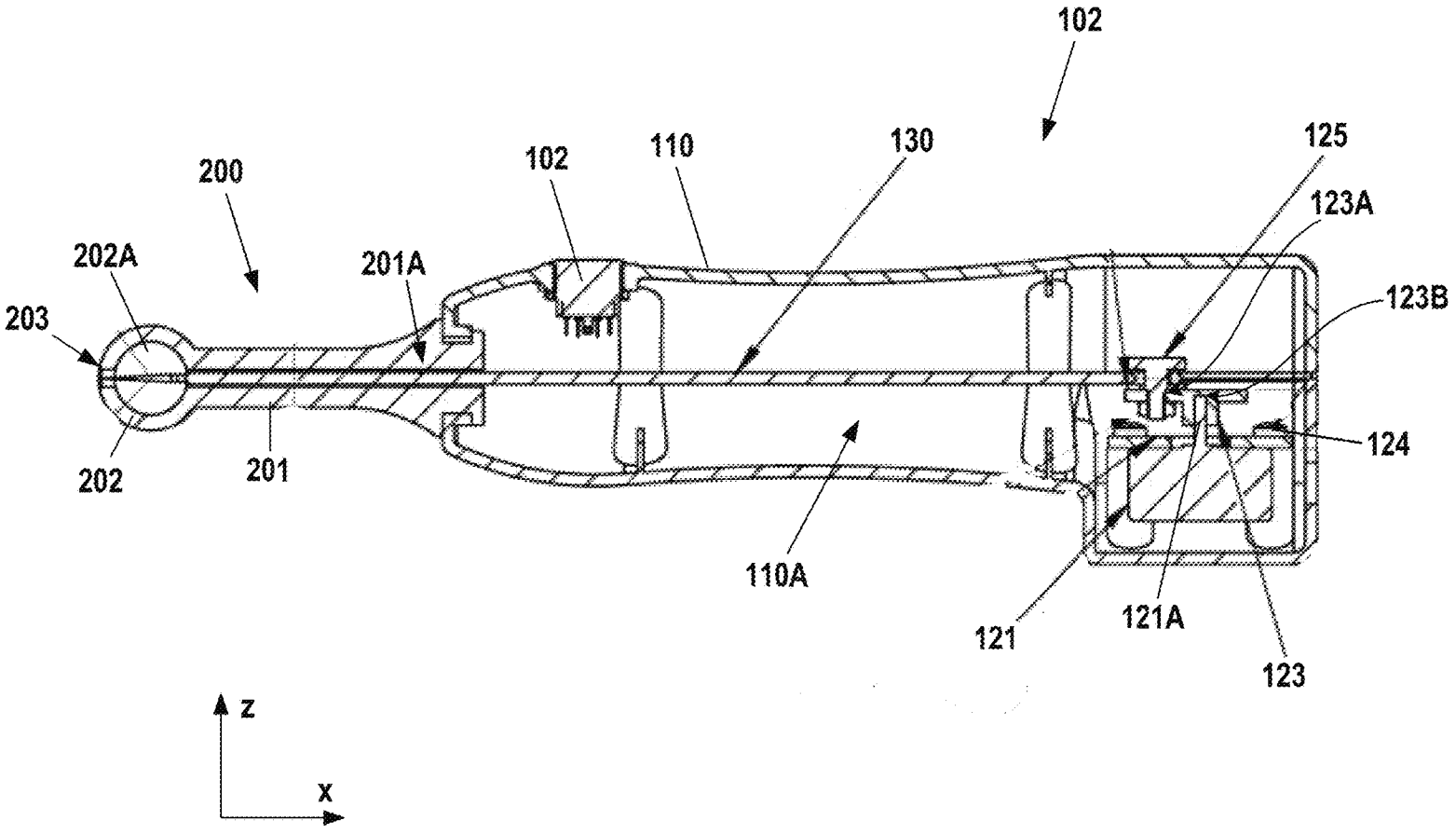
FIGS. 5A and 5B illustrate various cross-sectional views of an exemplary hair locking device in accordance with various embodiments described herein.
Figure 5B:
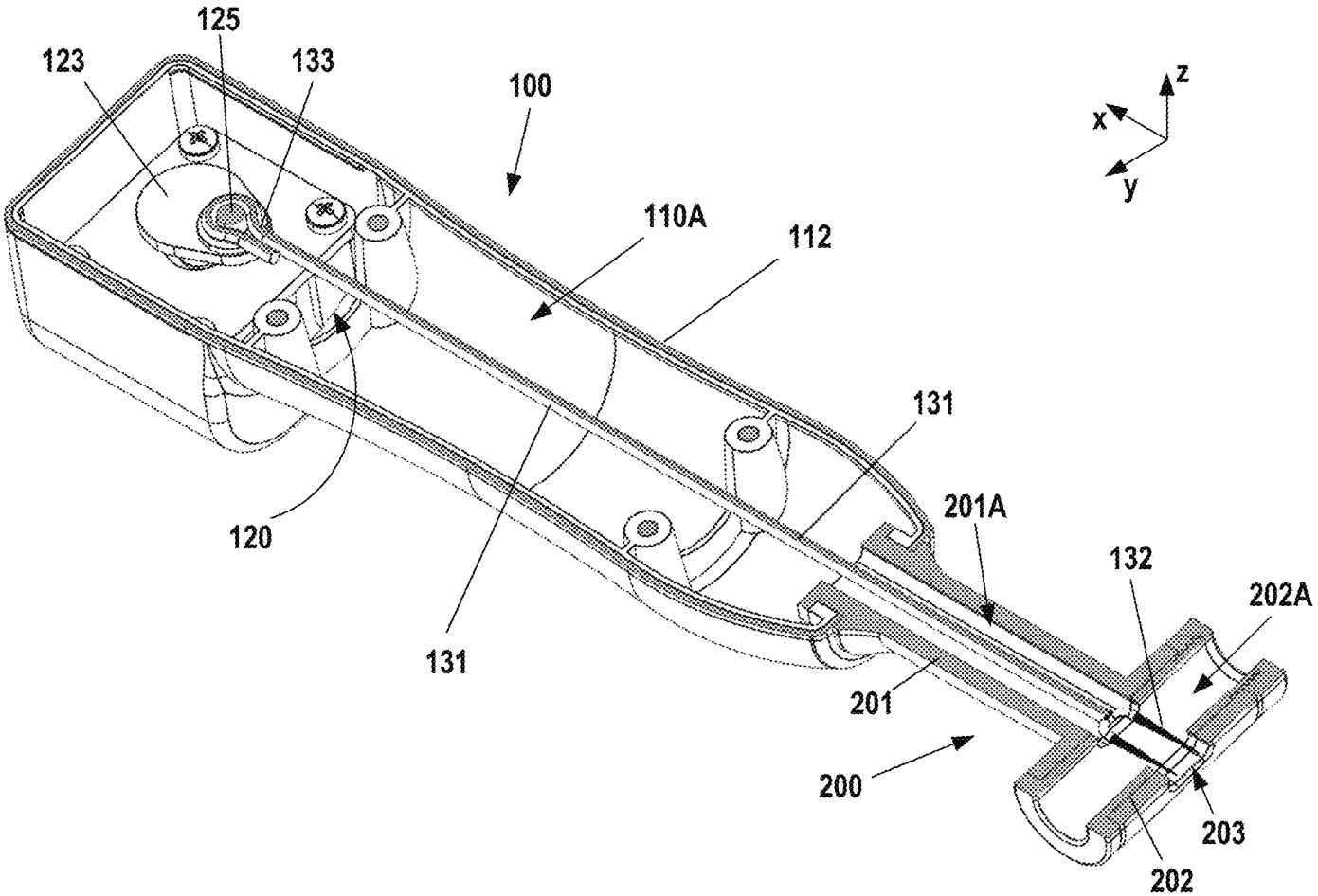

FIGS. 5A and 5B illustrate various cross-sectional views of an exemplary hair locking device in accordance with various embodiments described herein. As illustrated, the hair engagement tool 130 may be secured relative to the motor wheel 123 via a pin 125 configured to engage both the attachment feature 133 of the hair engagement tool 130 and the second opening 123B of the motor wheel 123 to restrict the relative motion therebetween. Further, the hair engagement tool 130 is arranged within the interior housing portion 100A of the housing 110 such that the length of the elongated stem 131 is oriented in an at least substantially longitudinal direction (e.g., in the x-direction as defined in the exemplary orientation illustrated in FIGS. 5A and 5B) defined between a first end 11 of the hair locking device 10 defined by the device body 100 and a second end 12 of the hair locking device 10 defined by the arm component 200. For example, the hair engagement tool 130 may be configured such that the length of the elongated stem 131 is arranged in between the attachment feature 133 and the stem element 201 (e.g., interior stem channel 201A) of the arm component 200.

In various embodiments, as described herein, the motor wheel 123 may comprise a first opening 123A defined along a first surface of the motor wheel 123 that is configured to receive at least a distal end of the motor stem 121A of the drive motor 121 therein. The motor wheel 123 may further comprise a second opening 123B that is separated from the first opening 123A by a radial separation distance and within which the motor wheel 123 is configured to receive at least a portion of the pin 125. For example, the attachment feature 133 of the hair engagement tool 130 may be secured relative to the motor wheel 123 at the second opening 123B via the pin 125 such that the attachment feature 133 is arranged at a radial distance away from the axis of rotation of the motor wheel 123 defined by the central axis of the motor stem 121A. During operation of the hair locking device 10 (e.g., upon user interaction with an activation button) the drive motor 121 is operated to rotate the motor stem 121A about a central axis thereof (e.g., oriented in the z-direction, as defined in the exemplary orientation of the embodiment illustrated in FIGS. 5A and 5B) such that, based at least in part on the radial separation distance between the attachment feature 133 secured relative to the second opening 123B and the axis of rotation of the motor wheel 123, the attachment feature 133 of the hair engagement tool 130 is rotated (e.g., with the motor wheel 123) through a rotational range of motion defined relative to the central axis of the motor stem 121A. For example, the rotation of the motor wheel 123 may cause the attachment feature 133 of the hair engagement feature 130 to rotate about the axis of rotation defined by the motor stem 121A in one or more rotational directions (e.g., in one or more of a clockwise rotational direction and and/or a counter-clockwise rotational direction) within a plane that is at least substantially perpendicular to the axis of rotation of the motor wheel 123, such as, for example, within the x-y plane, as defined by the exemplary orientation of the embodiment illustrated in FIGS. 5A and 5B.

In various embodiments, the rotation of the attachment feature 133 about the axis of rotation of the motor wheel 123 may drive a movement of the hair engagement tool (e.g., the engagement feature 123) through a range of motion that is defined in one or more linear directions. For example, in various embodiments, the range of motion of the hair engagement tool 130 during operation of the hair locking device 10 may be defined at least in part by a first movement of the engagement feature 132 relative to the arm component 200 in a longitudinal direction (e.g., in the x-direction as defined in the exemplary orientation of the embodiment illustrated in FIGS. 5A and 5B). For example, the range of motion of the hair engagement tool 130 may be defined at least in part by the engagement feature 132 thereof moving relative to the arm component 200 at least in one or more longitudinal directions between a first position, wherein the engagement feature 132 is disposed within the interior stem channel 201A of the stem element 201, and a second position, wherein the engagement feature 132 is positioned at least partially within the interior head channel 202A of the head element 202, as illustrated in FIGS. 5A and 5B. In various embodiments, when provided in the first position, the hair engagement tool 130 is arranged relative to the arm component 200 such that no portion of the engagement feature 132 is disposed within the interior head channel 202A of the head component 202 and at least a portion of the engagement feature is arranged within the interior stem channel 201A of the stem element 201. Further, when provided in the second position, the hair engagement tool 130 is arranged relative to the arm component 200 such that the elongated stem 131 extends through cross-sectional diameter of the interior head channel 202A such that at least a portion of the engagement feature 132 (e.g., a distal-most tip of the engagement feature 132) is disposed within the tool orifice 203.

Additionally and/or alternatively, in various embodiments, the range of motion of the hair engagement tool 130 during operation of the hair locking device 10 may further be defined at least in part by a second movement of the engagement feature 132 (e.g., and/or the elongated stem 131) in a lateral direction perpendicular to the longitudinal direction (e.g., in the y-direction as defined in the exemplary orientation of the embodiment illustrated in FIGS. 5A and 5B) based on the rotational movement of the attachment feature 133. For example, the range of motion of the hair engagement tool 130 may be defined at least in part by the engagement feature 132 and the elongated stem 131 moving at least partially laterally in one or more lateral directions relative to the arm component 200 as the attachment feature is rotated with the motor wheel 123 about the central axis of the motor stem 121A.

In various embodiments, the drive motor 121 may be configured to continuously rotate the motor stem 121A in the same rotational direction during operation thereof such that, during operation of the hair locking device 10, the movement of the hair engagement tool 130 through the range of motion may be defined by the cyclical movement of the engagement feature 132 back and forth between the first and second positions described above. In such an exemplary configuration, the drive motor 121 may be selectively operable to cause the hair engagement tool 130 to repeatedly move through a range of motion in which the engagement feature 132 thereof is inserted into and/or retracted from the interior head channel 202A of the arm component 200 to selectively engage, disengage, manipulate, and/or otherwise interact with a portion of the hair disposed within the interior head channel 202A.

Figure 6:
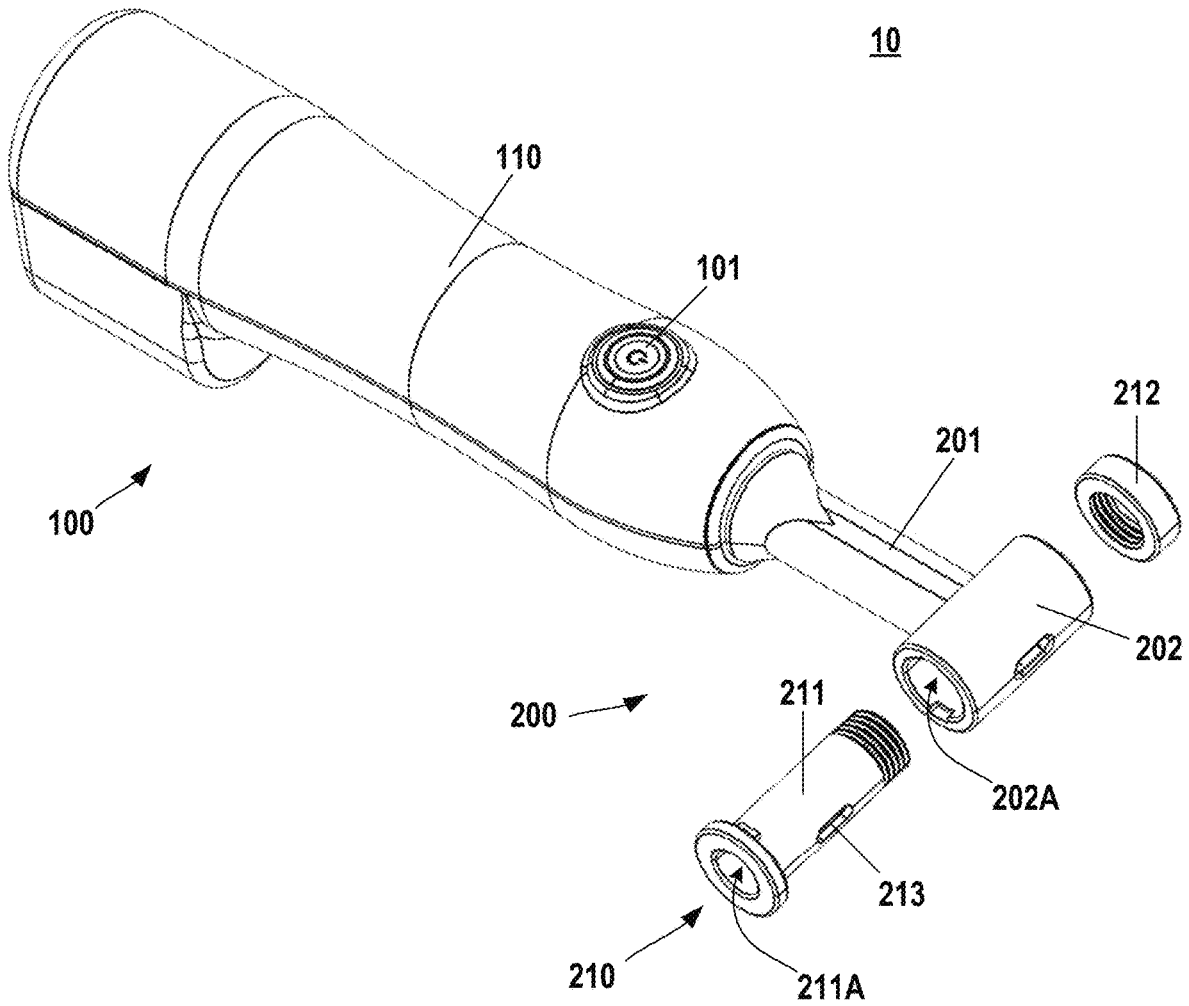
FIG. 6 illustrate an exploded view of an exemplary hair locking device with a removeable head insert component in accordance with various embodiments described herein.

FIG. 6 illustrate an exploded view of an exemplary hair locking device with a removeable head insert component in accordance with various embodiments described herein. In various embodiments, an exemplary hair locking device 10 may comprise a removeable head insert component 210 configured to be secured relative to the head element 202 of the arm component 200 to facilitate the selective variation of the cross-sectional diameter of the interior head channel 202A in order to accommodate different hair portions (e.g., dreadlocks) of different sizes (e.g., diameters). In various embodiments, the removeable head insert component 210 may comprise a removeable tube insert 211 configured for selective arrangement within the interior head channel 202A. The removeable tube insert 211 may have an at least substantially tubular configuration defined by a length that is at least substantially similar to that of the head component 202 and an interior insert channel 211A having a cross-sectional diameter that less than that of the interior head channel 202A. Further, in various embodiments, the removeable tube insert 211 may have an outer diameter defined by an exterior surface thereof that is at least substantially similar to the cross-sectional diameter of the interior head channel 202A, such that the removeable tube insert 211 is configured to fit securely within the interior head channel 202A of the head element 202.

In various embodiments, the removeable tube insert 211 of the removeable head insert component 210 may comprise an insert orifice 213 defined by an opening that extends through the removeable tube insert 211. For example, the insert orifice 213 may embody an opening, an aperture, a slot, and/or the like that extends between an interior insert channel 211A and an exterior surface of the removeable tube insert 211. In various embodiments, the removeable tube insert 211 may be configured such that, upon the removeable tube insert 211 being disposed within the interior head channel 202A, the insert orifice 213 may be positioned at an opposing end (e.g., an outermost portion) of the removeable tube insert 211 relative to the stem element 201 of the arm component 200. In various embodiments, the insert orifice 213 may be positioned along the removeable tube insert 211 such that at least a portion of the insert orifice 213 is aligned with the central axis of the stem element 201 (e.g., the interior stem channel 201A) and the tool orifice 203 of the head element 202. For example, the insert orifice 213 may be at least partially aligned with the interior stem channel 201A such that the during operation of the hair locking device, as a hair engagement tool is driven in an outward direction towards and/or into the interior insert channel 211A, at least a portion of the engagement feature of the hair engagement tool may be moved beyond the interior insert channel 211A such that it may be received within the insert orifice 213. For example, the insert orifice 213 may be configured to receive at least a portion of the hair engagement tool when the hair engagement tool is arranged in an outermost position relative to the device body. In such an exemplary configuration, the insert orifice 213 may be configured to enable the hair engagement tool to move through a full range of motion while the removeable head insert component 210 is installed to the head element 202, including enabling at least a portion of the engagement feature thereof to be moved from a first longitudinal position within the interior stem channel 201A, through a cross-sectional diameter of the interior insert channel 211A, and to a second longitudinal position within the insert orifice 213.

In various embodiments, the removeable head insert component 210 may further comprise a detachable insert cap 212 configured to engage a lateral end of the removeable tube insert 211 to at least partially secure the removeable head insert component 210 relative to the head component 202. For example, the detachable insert cap 212 may be secured to a threaded portion defined at a lateral end of the removeable tube inset 211 such that the detachable insert cap 212 functions to restrict the range of motion of the removeable head insert component 210 relative to the head element 202 in one or more lateral directions. Upon the removeable head insert component 210 being secured in an installed position relative to the head element 202 (e.g., such that the removeable tube insert 211 is coaxially arranged relative to the head element 202 within the interior head channel 202A) the operative cross-sectional area within which the arm component 200 is configured to receive a portion of hair (e.g., a dreadlock) may be less than that of the operative cross-sectional area defined by the head component 202 without the removeable head insert component 210 installed therein.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hair locking device comprising:

a device body comprising:

a housing defining an interior housing portion; and a motor assembly disposed within the interior housing portion of the housing;

an arm component configured for attachment to the device body, the arm component comprising a head element having a tubular configuration defined at least in part by an interior head channel configured for receiving a hair portion therein; and a hair engagement tool operatively connected to the motor assembly, wherein the hair engagement tool is configured to be moved through a range of motion relative to the arm component based at least in part on a selective operation of the motor assembly, and wherein the hair engagement tool comprises an engagement feature configured for selective engagement with the hair portion;

wherein the hair locking device is configured to be selectively operated to initiate a motor-drive movement of the hair engagement tool defined by the engagement feature moving relative to the interior head channel to enable a hair locking operation defined at least in part by an interaction of the engagement feature with the hair portion; and wherein the head element is arranged in an at least substantially perpendicular configuration relative to the stem element.

2. The hair locking device of claim 1, wherein the arm component is selectively detachable from the housing of the device body.

3. The hair locking device of claim 1, wherein the arm component comprises a stem element configured for attachment to the device body, wherein the stem element defines a stem length between a first stem end and a second stem end, and wherein the head element is arranged relative to the second stem end and an arm attachment feature of the stem element is defined at the first stem end.

4. The hair locking device of claim 3, wherein the stem element defines an interior stem channel that is fluidly connected to the interior housing portion of the housing of the device body via a first opening defined at the first stem end of the stem element.

5. The hair locking device of claim 4, wherein the interior stem channel of the stem element is fluidly connected to the interior head channel via a second opening defined at the second stem end of the stem element.

6. The hair locking device of claim 1, wherein the engagement feature of the hair engagement tool defines a two-pronged engagement element.

7. The hair locking device of claim 1, wherein the hair engagement tool further comprises an elongated stem and an attachment feature, the attachment feature being configured for engagement with at least a portion of the motor assembly to facilitate the operative connection of the hair engagement tool thereto.

8. The hair locking device of claim 7, wherein the attachment feature is defined at a first end of the elongated stem and the engagement feature is defined on an opposing second end of the elongated stem.

9. The hair locking device of claim 1, wherein the hair locking device is configured such that the movement of the hair engagement tool through the range of motion is defined at least in part by the engagement feature moving in one or more longitudinal directions.

10. The hair locking device of claim 1, wherein the hair engagement tool is made of an at least substantially metallic material.

11. The hair locking device of claim 1, wherein the head element of the arm component comprises a tool orifice fluidly connected with the interior head channel.

12. The hair locking device of claim 11, wherein the tool orifice is at least partially aligned with a central axis of a stem element of the arm component, the stem element being disposed between the head element and the housing of the device body.

13. The hair locking device of claim 1, wherein the motor assembly comprises a drive motor operable to drive rotation of a motor stem, and a motor wheel defining a first opening configured for engagement with the motor stem such that the motor wheel is configured to rotate about an axis of rotation defined by a central axis of the motor stem.

14. The hair locking device of claim 13, wherein the motor wheel further defines a second opening configured to receive a fastener element therein such that an attachment feature of the hair engagement tool is secured relative to the second opening of the motor wheel, and wherein the second opening is defined at a radial distance away from the axis of rotation of the motor wheel such that the rotation of the motor stem operably causes the attachment feature of the hair engagement tool to rotate about the axis of rotation with the motor wheel.

15. The hair locking device of claim 13, wherein the motor assembly is electronically connected to an activation button disposed about an exterior surface of the housing such that the drive motor of the motor assembly is selectively operable via one or more user interactions with the activation button.

16. A hair locking device comprising:

a device body comprising:

a housing defining an interior housing portion; and a motor assembly disposed within the interior housing portion of the housing;

an arm component configured for attachment to the device body, the arm component comprising a head element having a tubular configuration defined at least in part by an interior head channel configured for receiving a hair portion therein; and a hair engagement tool operatively connected to the motor assembly, wherein the hair engagement tool is configured to be moved through a range of motion relative to the arm component based at least in part on a selective operation of the motor assembly, and wherein the hair engagement tool comprises an engagement feature configured for selective engagement with the hair portion;

wherein:

the hair locking device is configured to be selectively operated to initiate a motor-drive movement of the hair engagement tool defined by the engagement feature moving relative to the interior head channel to enable a hair locking operation defined at least in part by an interaction of the engagement feature with the hair portion;

the hair locking device is configured such that the movement of the hair engagement tool through the range of motion is defined at least in part by the engagement feature moving in one or more longitudinal directions; and the hair engagement tool moving through the range of motion is defined at least in part by the engagement feature being moved between a first position defined within the interior head channel of the head element and a second position defined within an interior stem channel of a stem element defined by the arm component.

17. The hair locking device of claim 16, wherein the arm component is selectively detachable from the housing of the device body.

18. A hair locking device comprising:

a device body comprising:

a housing defining an interior housing portion; and a motor assembly disposed within the interior housing portion of the housing;

an arm component configured for attachment to the device body, the arm component comprising a head element having a tubular configuration defined at least in part by an interior head channel configured for receiving a hair portion therein; and a hair engagement tool operatively connected to the motor assembly, wherein the hair engagement tool is configured to be moved through a range of motion relative to the arm component based at least in part on a selective operation of the motor assembly, and wherein the hair engagement tool comprises an engagement feature configured for selective engagement with the hair portion;

wherein:

the hair locking device is configured to be selectively operated to initiate a motor-drive movement of the hair engagement tool defined by the engagement feature moving relative to the interior head channel to enable a hair locking operation defined at least in part by an interaction of the engagement feature with the hair portion; and the hair locking device further comprises a removeable head insert component configured to be selectively secured relative to the head element to reduce an operable cross-sectional area within which the head element is configured to receive the hair portion.

19. The hair locking device of claim 18, wherein the removeable head insert component comprises a removeable tube insert configured to be disposed within the interior head channel of the head element, the removeable tube insert defining an interior insert channel defined by a first cross-sectional area that is at least substantially less than a second cross-sectional area defined by the interior head channel.

20. The hair locking device of claim 19, wherein the removeable head insert component further comprises a detachable insert cap configured to selectively engage the removeable tube insert to secure the removeable tube insert in one or more directions relative to the head element.

* * * * *